US009267757B2

(12) United States Patent
Li

(10) Patent No.: US 9,267,757 B2
(45) Date of Patent: Feb. 23, 2016

(54) AIR RIFLE

(71) Applicant: Xilong Li, Guangzhou (CN)
(72) Inventor: Xilong Li, Guangzhou (CN)
(73) Assignee: Nanjing Airgun Manufacturing Ltd., Nanjing (CN)

( * ) Notice: Subject to any disclaimer, the term of this patent is extended or adjusted under 35 U.S.C. 154(b) by 26 days.
(21) Appl. No.: 14/450,274
(22) Filed: Aug. 3, 2014
(65) Prior Publication Data
US 2015/0053194 A1 Feb. 26, 2015
(30) Foreign Application Priority Data
Aug. 21, 2013 (CN) ..... 2013 1 0364023
Aug. 21, 2013 (CN) ..... 2013 2 0508240 U
(51) Int. Cl.
*F41B 11/683* (2013.01)
*F41B 11/723* (2013.01)
*F41A 17/48* (2006.01)
*F41A 17/52* (2006.01)
(52) U.S. Cl.
CPC ..... *F41B 11/723* (2013.01); *F41B 11/683* (2013.01); *F41A 17/48* (2013.01); *F41A 17/52* (2013.01)
(58) Field of Classification Search
CPC ..... F41B 11/00; F41B 11/60; F41B 11/68; F41B 11/681–11/683; F41A 17/48; F41A 17/52
USPC ..... 124/71, 73, 76, 56, 69, 63
See application file for complete search history.

(56) References Cited

U.S. PATENT DOCUMENTS 2,119,441 A * 5/1938 Price ..... F41B 11/51 124/45
2,604,088 A * 7/1952 Wells ..... F41B 11/723 124/37
2,638,884 A * 5/1953 Wells ..... F41B 11/723 124/67
3,763,843 A * 10/1973 Fisher ..... F41B 11/723 124/69
3,800,773 A * 4/1974 Fischer ..... F41B 11/683 124/69
3,802,408 A * 4/1974 Joyce ..... F41B 11/723 124/75
3,810,455 A * 5/1974 Garmon, Jr. ..... F41B 11/50 124/44.6
4,282,852 A * 8/1981 Omana ..... F41B 11/00 124/67
5,224,465 A * 7/1993 Milliman ..... F41B 11/723 124/69
5,341,790 A * 8/1994 Ebert ..... F41B 11/723 124/69
5,617,837 A * 4/1997 Momirov ..... F41B 11/683 124/69
6,581,585 B2 * 6/2003 Nibecker, Jr. ..... F41B 11/723 124/69
2003/0094167 A1 * 5/2003 Nibecker, Jr. ..... F41B 11/723 124/64

* cited by examiner

*Primary Examiner* — Jonathan C Weber
(74) *Attorney, Agent, or Firm* — Matthias Scholl, PC; Matthias Scholl

(57) ABSTRACT

An air rifle including a supporting frame, a barrel, a pneumatic assembly, an air storage assembly, and a firing assembly. The barrel, the pneumatic assembly, the air storage assembly, and the firing assembly are all disposed on the supporting frame. The pneumatic assembly is connected to the air storage assembly. The air storage assembly includes an air cylinder, an air valve disposed at one side of the air cylinder, and a plastic member disposed at a connection part of the barrel and the air valve. A firing pin is fixed on the tail of the plastic member. The firing assembly includes a trigger support fixed on the supporting frame, a pushrod disposed on the trigger support, a trigger, a trigger buckle, and a hammer. The trigger is connected to the trigger buckle. The pushrod is adapted to slide on the trigger support.

5 Claims, 4 Drawing Sheets

AIR RIFLE

CROSS-REFERENCE TO RELATED APPLICATIONS

Pursuant to 35 U.S.C. § 119 and the Paris Convention Treaty, this application claims the benefit of Chinese Patent Application No. 201320508240.3 filed Aug. 21, 2013 and Chinese Patent Application No. 201310364023.6 filed Aug. 21, 2013. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18$^{th}$ Floor, Cambridge, Ma. 02142.

BACKGROUND OF THE INVENTION

1. Field of the Invention

The invention relates to an air rifle.

2. Description of the Related Art

Air rifle is a cold power firing device that is adapted to instantly release compressed air to drive a bullet. As far as a typical air rifle is concerned, the air valve has a bad control on the air release of the air storage chamber, the instantaneous air pressure is small, and the controllability of the trigger is poor.

SUMMARY OF THE INVENTION

In view of the above-described problems, it is one objective of the invention to provide an improved air rifle.

To achieve the above objective, in accordance with one embodiment of the invention, there is provided an air rifle comprising a supporting frame, a barrel, a pneumatic assembly, an air storage assembly, and a firing assembly. The barrel, the pneumatic assembly, the air storage assembly, and the firing assembly are all disposed on the supporting frame. The pneumatic assembly is connected to the air storage assembly. The air storage assembly comprises an air cylinder, an air valve disposed at one side of the air cylinder, and a plastic member disposed at a connection part of the barrel and the air valve. A firing pin is fixed on a tail of the plastic member. The firing assembly comprises a trigger support fixed on the supporting frame, a pushrod disposed on the trigger support, a trigger, a trigger buckle, and a hammer. The pushrod moves forward and backward for the loading of a bullet. The trigger is connected to the trigger buckle. The pushrod is adapted to slide on the trigger support. The pushrod is in a flexible connection to the hammer and controls the hammer to reset and clamp on the trigger buckle. A spring is connected to the hammer.

When the pneumatic assembly compresses external air toward the air valve, the plastic member is sealed at the connection part of the barrel and the air valve. When the firing assembly is triggered, the hammer pushes against the firing pin, and the plastic member is detached from the connection part of the barrel and the air valve.

In a class of this embodiment, the trigger and the trigger buckle are fixed on the trigger support via a pivot. The trigger and the trigger buckle are fixedly connected. The hammer comprises an elongate groove and a projection. The trigger buckle comprises a first hook matching the elongate groove. The pushrod comprises a second hook matching the projection.

In a class of this embodiment, the trigger assembly further comprises a loading safety device and a triggering safety device. The loading safety device comprises a rear stop pin disposed in the trigger support and capable of moving upward and downward. The bottom of the rear stop pin presses on the top of the trigger thereby restricting the revolving of the trigger. The pushrod is disposed above the rear stop pin. The triggering safety device comprises a trigger safety disposed on the trigger support and capable of moving. The trigger comprises a clasp matching the trigger safety.

In a class of this embodiment, the triggering safety device further comprises a safety sheath. The pneumatic assembly comprises a boss matching the safety sheath.

In a class of this embodiment, the pneumatic assembly comprises a piston disposed in the air cylinder, and a piston cup and a connecting bar which are disposed at two ends of the piston. A compression bar is connected to the connecting bar in a transmission way. The air valve is disposed at one end of the air cylinder in the proximity of the piston cup. The air valve further comprises a check valve which is connected to an internal spring.

Compared with the prior art, advantages of the invention are summarized as follows. The air storage assembly comprises an air cylinder, an air valve disposed at one side of the air cylinder, and a plastic member disposed at a connection part of the barrel and the air valve. The firing pin is fixed on a tail of the plastic member. The firing assembly comprises a trigger support fixed on the supporting frame, a pushrod disposed on the trigger support, a trigger, a trigger buckle, and a hammer. The trigger is connected to the trigger buckle. The pushrod is adapted to slide on the trigger support. The pushrod is in a flexible connection to the hammer and controls the hammer to reset and clamp on the trigger buckle. A spring is connected to the hammer. When the pneumatic assembly compresses external air toward the air valve, the plastic member is sealed at the connection part of the barrel and the air valve. When the firing assembly is triggered, the hammer pushes against the firing pin, and the plastic member is detached from the connection part of the barrel and the air valve. Thus, the air valve can effectively control the air release of the air storage chamber, the instantaneous air pressure is large, and the trigger is highly controllable.

DETAILED DESCRIPTION OF THE EMBODIMENTS

Figure 1:
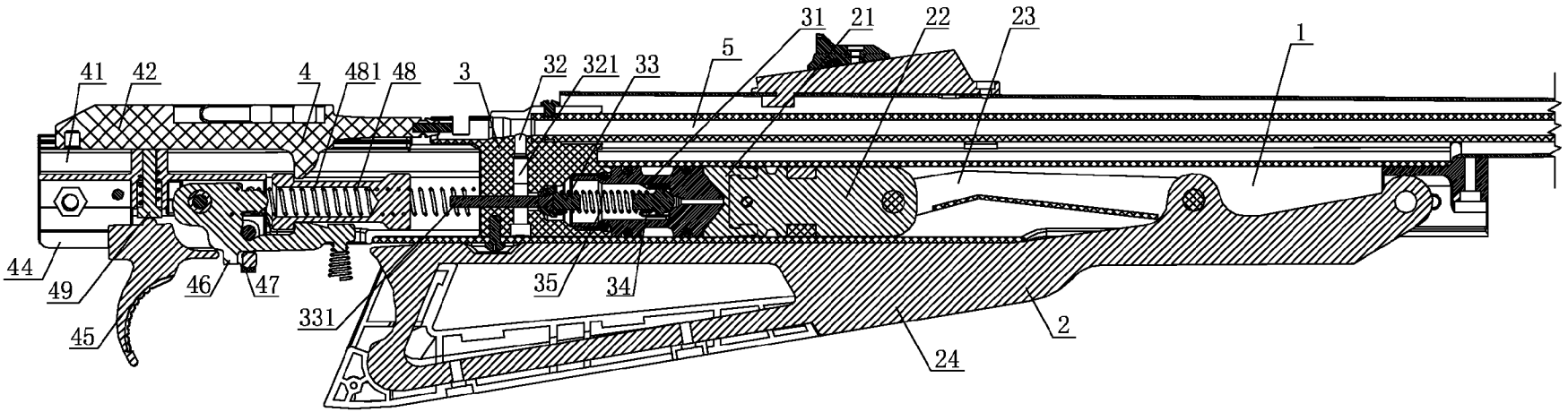
FIG. 1 is a schematic diagram of an air rifle in accordance to one embodiment of the invention.

For further illustrating the invention, experiments detailing an air rifle are described below. It should be noted that the following examples are intended to describe and not to limit the invention.

As shown in FIGS. 1-4, the invention provides an air rifle which is adapted to repeatedly compress the external air for the energy storage. The air rifle comprises a supporting frame 41, a barrel 5, a pneumatic assembly 2, an air storage assembly 3, and a firing assembly 4. The barrel 5, the pneumatic assembly 2, the air storage assembly 3, and the firing assembly 4 are all disposed on the supporting frame 41. The pneumatic assembly 2 is connected to the air storage assembly 3. The air storage assembly 3 comprises an air cylinder 1, an air valve disposed at one side of the air cylinder 1, and a plastic member 33 disposed at a connection part of the barrel 5 and the air valve. The air valve comprises a front part 31 and a rear part 32. A firing pin 331 is fixed on a tail of the plastic member 33. The firing assembly 4 comprises a trigger support 44 fixed on the supporting frame 41, a pushrod 42 disposed on the trigger support 44, a trigger 45, a trigger buckle 46, and a hammer 48. The pushrod 42 moves forward and backward for the loading of a bullet. The trigger 45 is connected to the trigger buckle 46. The pushrod 42 is adapted to slide on the trigger support 44. The pushrod 42 is in a flexible connection to the hammer 48 and controls the hammer 48 to reset and clamp on the trigger buckle 46. A spring 481 is connected to the hammer 48. When the pneumatic assembly 2 compresses external air toward the air valve, the plastic member 33 is sealed at the connection part 321 of the barrel 5 and the air valve. When the firing assembly 4 is triggered, the hammer 48 pushes against the firing pin 331, and the plastic member 33 is detached from the connection part of the barrel 5 and the air valve. In practice, the pneumatic assembly 2 can repeatedly compress the external air into the front part 31 of the air valve for storage. Thus, the compressed air in the front part 31 of the air valve has a certain pressure. When the firing assembly 4 is triggered to hit the plastic member 33, the air between the front part and the rear part of the air valve is instantly released and enters the barrel 5 to drive the bullet.

The trigger 45 and the trigger buckle 46 are fixed on the trigger support 44 via a pivot. The trigger 45 and the trigger buckle 46 are fixedly connected. The hammer 48 comprises an elongate groove and a projection. The trigger buckle 46 comprises a first hook matching the elongate groove. The pushrod comprises a second hook matching the projection. When the pushrod 42 is pulled back for loading, the back pull resulting from the pushrod and exerted on the projection of the hammer leads the hammer to move back until the elongate groove is hooked on the first hook of the trigger buckle 46. Thus, the plastic member 33 resets.

The trigger assembly 4 further comprises a loading safety device and a triggering safety device. The loading safety device comprises a rear stop pin 49 disposed in the trigger support 44 and capable of moving upward and downward. The bottom of the rear stop pin 49 presses on the top of the trigger 45 thereby restricting the revolving of the trigger. The pushrod 42 is disposed above the rear stop pin 49. When the bullet is not loaded, the trigger 45 is locked by the rear stop pin 49, which effectively avoids the absence of the bullet and the release of the compressed air thereby injuring people. Only when the pushrod 42 moves forward to seal the loading port, which makes room for the rear stop pin 49, the triggering can be achieved. The triggering safety device comprises a trigger safety 47 disposed on the trigger support and capable of moving. The trigger 45 comprises a clasp matching the trigger safety 47. The trigger safety 47 is revolved to cooperate with the clasp to allow or restrict the revolving of the trigger.

The triggering safety device further comprises a safety sheath 471. The pneumatic assembly 2 comprises a boss matching the safety sheath 471. The boss and the safety sheath 471 cooperate to control the automatic opening of the trigger safety. Specifically, when the pneumatic assembly 2 compresses the air, the tail thereof contacts with the safety sheath 471 of the triggering safety device whereby driving the safety sheath to move backward and open the trigger safety. Thereafter, the pneumatic assembly detaches from the safety sheath. Only manually push the safety sheath forward and compress the air again by the pneumatic assembly, the tail of the pneumatic assembly can contact with the safety sheath for the automatic opening of the trigger safety.

The pneumatic assembly 2 comprises a piston 22 disposed in the air cylinder 1, and a piston cup 21 and a connecting bar 23 which are disposed at two ends of the piston. A compression bar 24 is connected to the connecting bar 23 in a transmission way. The air valve is disposed at one end of the air cylinder in the proximity of the piston cup. The air valve further comprises a check valve 34 which is connected to an internal spring 35. The operation of the compression bar 24 of the pneumatic assembly 2 can drive the connecting bar and the piston to move forward and backward repeatedly, so that the air is constantly compressed and stored in the front part of the air valve. Once being released, the stored compressed air provides power for the firing of the bullet. Furthermore, for the convenience of operation, the compression bar 24 comprises hand holes.

In reference to FIGS. 1-4, the working process of the air rifle is summarized as follows.

As shown in FIG. 1, the trigger 45 and the trigger buckle 46 are fixed on the same pivot. When the pushrod 42 is pulled back for loading, the hammer 48 is driven to move backward and detach from the plastic member 33. Thus, the plastic member 33 is sealed on the outlet of the rear part 32 of the air valve, that is to say, the plastic member 33 is sealed at the connection part 321 of the barrel 5 and the air valve. Meanwhile, under the drive of the spring force, the trigger buckle 46 revolves upwards to hang on the projection of the hammer 48 moving backward. During the backward movement of the pushrod 42, the rear stop pin 49 cannot lift up, and thus the trigger 45 cannot revolve, which ensures the loading safety. With the continuation of the backward movement of the pushrod 42, the loading groove is exposed. Then, load the bullet in the loading groove, and push the pushrod 42 forward whereby completing the loading of the bullet.

Figure 2:
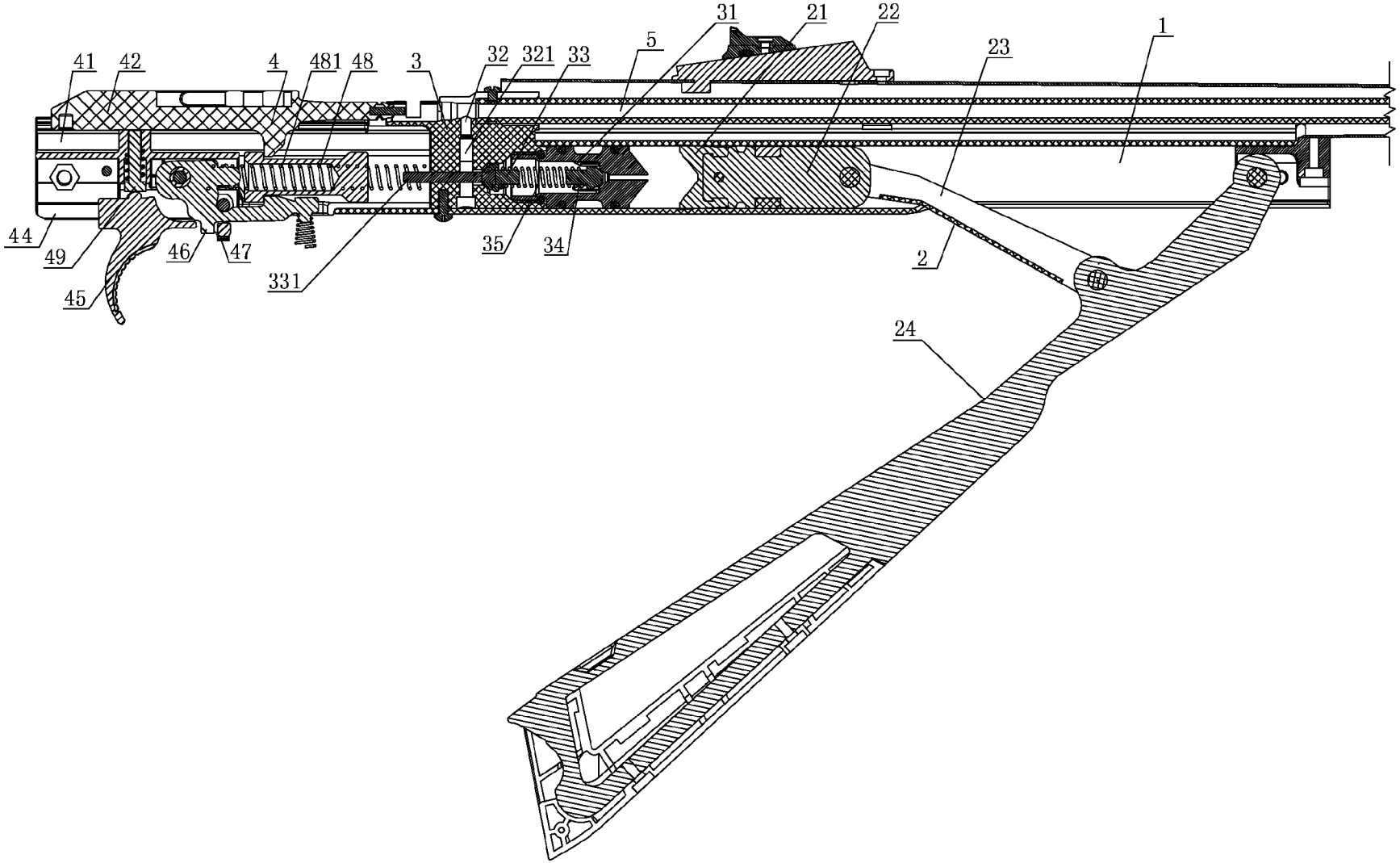
FIG. 2 is a schematic diagram of an air rifle where a pneumatic assembly thereof is working in accordance to one embodiment of the invention.

Prior to firing, the air rifle is required to compress air and store energy for firing the bullet. As shown in FIG. 2, when the compression bar 24 is pulled forward, the connecting bar 23 and the piston 22 in the air cylinder 1 are driven by the compression bar 24 to move leftward, and thus the external air enters the air cylinder 1 through an air inlet disposed on the air cylinder 1. The compressed air drives the check valve 34 to move leftward, so that an air passage is formed between the air cylinder 1 and the front part 31 of the air valve. Therefore, the compressed air in the air cylinder 1 is delivered to the front part of the air valve. When the piston 22 moves to the leftmost, the piston cup 21 tightly leans against the front part 31 of the air valve, and all the air is compressed and stored in the front part of the air valve. When the compression bar 24 is pulled backward, the connecting bar 23 and the piston 22 in the air cylinder 1 are driven by the compression bar 24 to move rightward. Under the pressure resulting from the compressed air in the front part of the air valve, the check valve 34 is in a close state, whereby preventing the compressed air in the front part of the air valve from flowing backward to the air cylinder 1. When the compression bar 24 is pulled forward again, the external air enters the air cylinder 1 through the air inlet disposed on the air cylinder 1, and is compressed by the piston 22 and the check valve 34 and stored in the front part 31 of the air valve. The compression operation is carried out for several times by the pneumatic assembly 2 until the compressed air stored between the front part and the rear part of the air valve reaches a satisfied pressure, which is used for the firing of the bullet.

Figure 3:
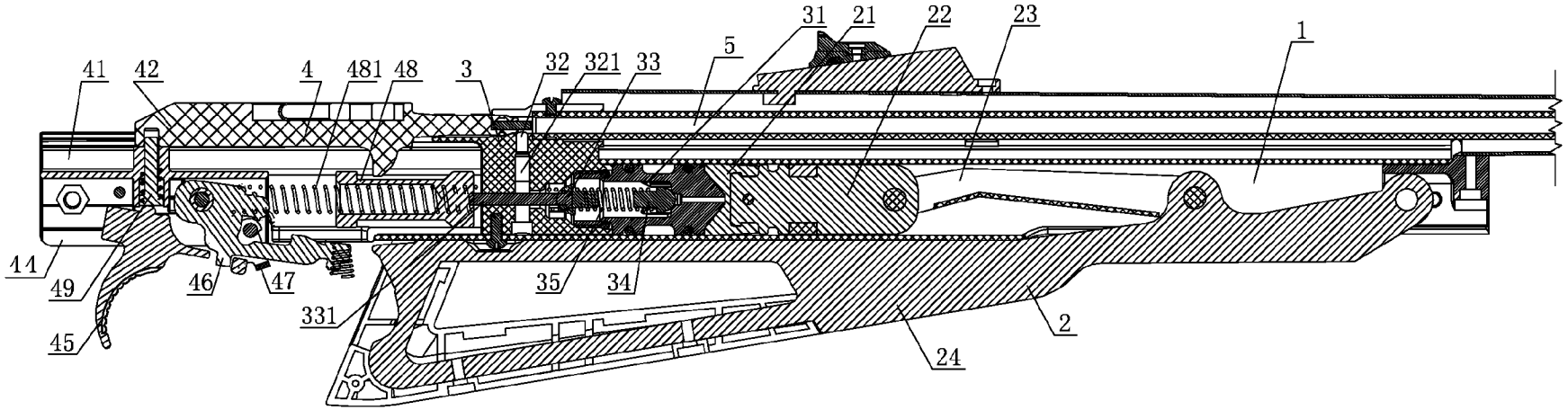
FIG. 3 is a schematic diagram of an air rifle where a trigger thereof is triggered in accordance to one embodiment of the invention.
Figure 4:
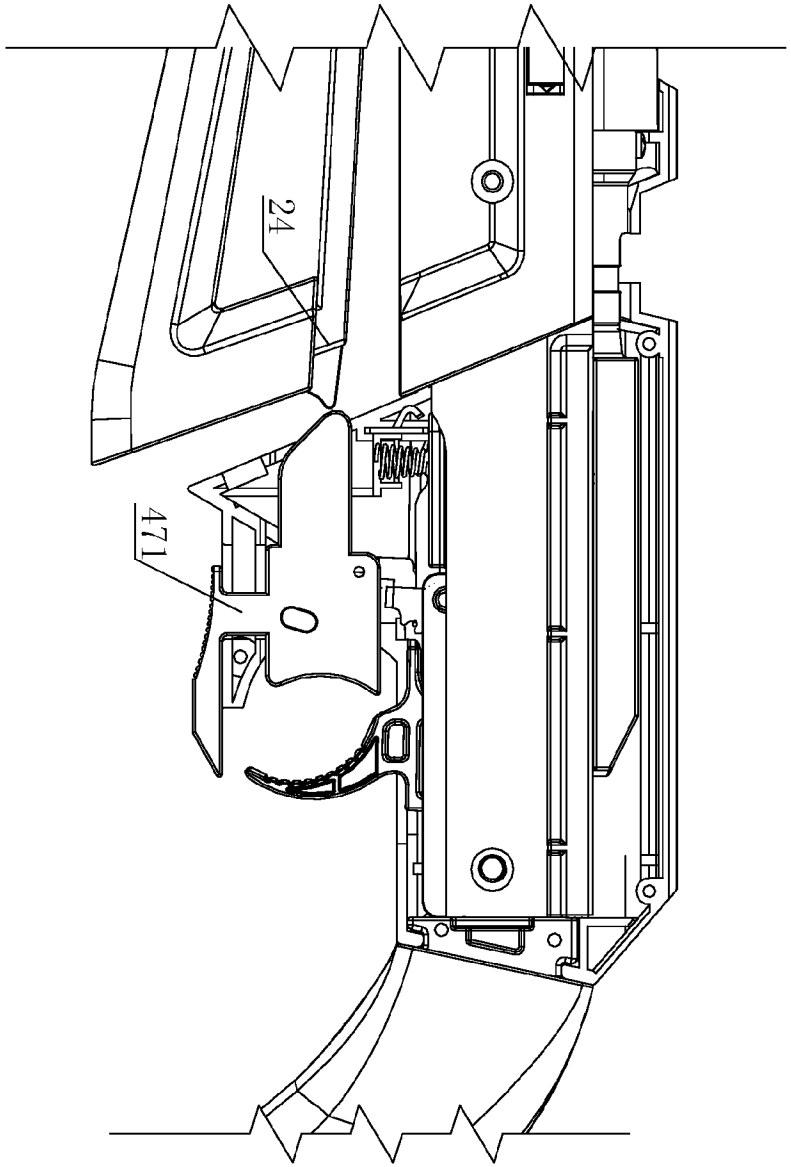
FIG. 4 is a schematic diagram of a triggering safety device of an air rifle in accordance to one embodiment of the invention.

After the bullet is loaded, the forward movement of the pushrod 42 makes room for the rear stop pin 49. Thus, the trigger 45 can move. When the trigger 45 is triggered, it revolves with the pivot as the axle center and pulls the trigger buckle 46 to move circumferentially. The trigger buckle 46 detaches from the hammer 48. Thereafter, the spring 481 connected to the hammer tends to reset. With reference to FIG. 3, due to the release of the elastic potential energy of the spring 481, the hammer 48 impacts the firing pin 331 fixed on the tail of the plastic member 33 to move away the plastic member 33 and open the air outlet of the rear part of the air valve, thereby unsealing the connection part 321 of the barrel 5 and the air valve and releasing the compressed air to drive the bullet. After firing, the pushrod 42 is pulled backward again, the hammer 48 is driven to move backward and clasp the first hook of the trigger buckle 46. Thereafter, the pushrod 42 is pushed forward, and the bullet is loaded for the next firing.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An air rifle, comprising:

a) a supporting frame;

b) a barrel;

c) a pneumatic assembly;

d) an air storage assembly; and e) a firing assembly;

wherein the barrel, the pneumatic assembly, the air storage assembly, and the firing assembly are all disposed on the supporting frame;

the pneumatic assembly is connected to the air storage assembly;

the air storage assembly comprises an air cylinder, an air valve disposed at one side of the air cylinder, and a plastic member disposed at a connection part of the barrel and the air valve;

a firing pin is fixed on a tail of the plastic member;

the firing assembly comprises a trigger support fixed on the supporting frame, a pushrod disposed on the trigger support, a trigger, a trigger buckle, and a hammer;

the pushrod is adapted to move forward and backward for the loading of a bullet;

the trigger is connected to the trigger buckle;

the pushrod is adapted to slide on the trigger support;

the pushrod is in a flexible connection to the hammer and controls the hammer to reset and clamp on the trigger buckle;

a spring is connected to the hammer;

when the pneumatic assembly compresses external air toward the air valve, the plastic member is sealed at the connection part of the barrel and the air valve; and when the firing assembly is triggered, the hammer pushes against the firing pin, and the plastic member is detached from the connection part of the barrel and the air valve.

2. The air rifle of claim 1, wherein the trigger and the trigger buckle are fixed on the trigger support via a pivot;

the trigger and the trigger buckle are fixedly connected;

the hammer comprises an elongate groove and a projection;

the trigger buckle comprises a first hook matching the elongate groove; and the pushrod comprises a second hook matching the projection.

3. The air rifle of claim 1, wherein the trigger assembly further comprises a loading safety device and a triggering safety device;

the loading safety device comprises a rear stop pin disposed in the trigger support and adapted to move upward and downward;

a bottom of the rear stop pin presses on a top of the trigger thereby restricting the revolving of the trigger;

the pushrod is disposed above the rear stop pin;

the triggering safety device comprises a trigger safety disposed on the trigger support and capable of moving; and the trigger comprises a clasp matching the trigger safety.

4. The air rifle of claim 3, wherein the triggering safety device further comprises a safety sheath, and the pneumatic assembly comprises a boss matching the safety sheath.

5. The air rifle of claim 1, wherein the pneumatic assembly comprises a piston disposed in the air cylinder, and a piston cup and a connecting bar which are disposed at two ends of the piston;

a compression bar is connected to the connecting bar in a transmission way;

the air valve is disposed at one end of the air cylinder in the proximity of the piston cup; and the air valve further comprises a check valve which is connected to an internal spring.

* * * * *